US005643405A

United States Patent [19]

Bello et al.

[11] Patent Number: 5,643,405

[45] Date of Patent: Jul. 1, 1997

[54] METHOD FOR POLISHING A SEMICONDUCTOR SUBSTRATE

[75] Inventors: Fernando A. Bello, Scottsdale; James B. Hall, Chandler; Otto Luedke; Earl W. O'Neal, both of Scottsdale, all of Ariz.

[73] Assignee: Motorola, Inc., Schaumburg, Ill.

[21] Appl. No.: 509,685

[22] Filed: Jul. 31, 1995

[51] Int. Cl.[6] ..... H01L 21/302

[52] U.S. Cl. ..... 156/636.1; 156/653.1; 156/657.1; 437/225; 437/228; 437/946

[58] Field of Search ..... 156/636.1, 653.1, 156/645.1, 657.1, 662.1; 437/249, 966, 946, 974, 228, 225

[56] References Cited

U.S. PATENT DOCUMENTS 5,389,579 2/1995 Wells .

*Primary Examiner*—Thorl Chea

*Attorney, Agent, or Firm*—Kevin B. Jackson

[57] ABSTRACT

An improved method for polishing a semiconductor substrate includes forming a protective layer (21) on one major surface (24) of a substrate (19) to form a protected side and polishing an unprotected surface (26) of the substrate (19) with a double sided polisher (11). During the polishing process, material from the unprotected side (26) is removed at a faster rate than material from the protected side. The method provides a single side polished substrate (19) with improved flatness characteristics. In an additional embodiment, polishing pads (13,23) having different surface contact characteristics are used to support process automation.

19 Claims, 1 Drawing Sheet

39

METHOD FOR POLISHING A SEMICONDUCTOR SUBSTRATE

BACKGROUND OF THE INVENTION

This invention relates, in general, to semiconductor processing and more particularly to methods for polishing semiconductor substrates.

The semiconductor industry is designing integrated circuit (IC) devices that incorporate increasingly smaller and more complex geometries. As a result, the materials and equipment used to manufacture such devices are subject to increasingly tighter constraints. For example, the semiconductor substrates or wafers used to build the IC devices must have low concentrations of defects and must be extremely flat.

Techniques for making semiconductor substrates are well known. Once an ingot of semiconductor material has been grown and shaped, it is sawn into individual substrates followed by a lapping or grinding process to make them more flat and parallel. Next, the substrate edges are rounded using an edge grind process. After edge grind, the substrates are etched to remove any work damage and contamination. Next, the substrates are polished on one or both sides, cleaned and scrubbed to provide a starting substrate ready for IC device manufacture.

Typically, substrate flatness is characterized by parameters such as total thickness variation (TTV) and site focal plane deviation (SFPD). The TTV of a substrate is the difference between the minimum and maximum thickness values measured across the surface of the substrate. The SFPD is the greatest distance above or below a selected focal plane and is measured either using a front side reference or a back side reference. Typically, many sites on a substrate are measured for focal plane deviation and yield is determined by the number of sites meeting a specified focal plane deviation value (e.g., less than 0.5 micron). With a back side reference SFPD (which is a more stringent test than the front side reference SFPD), the focal plane deviation is calculated based on a reference plane that is parallel to the back side of the substrate and that contains the center of the site being measured.

When polishing one side of a semiconductor substrate, manufacturers use either single sided or double sided polishing equipment with double sided polishing equipment providing improved flatness characteristics compared to single sided polishing equipment. However, although progress has been made in achieving flatter semiconductor substrates, improved methods are still needed that produce substrates with enhanced flatness in order to support the semiconductor industry's push towards IC designs with smaller and more complex geometries. Also, it would advantageous to produce such substrates in a cost effective and reproducible manner. Additionally, it would be of further advantage for the methods to produce substrates with enhanced flatness independent of substrate diameter.

DETAILED DESCRIPTION OF THE DRAWINGS

Figure 1:
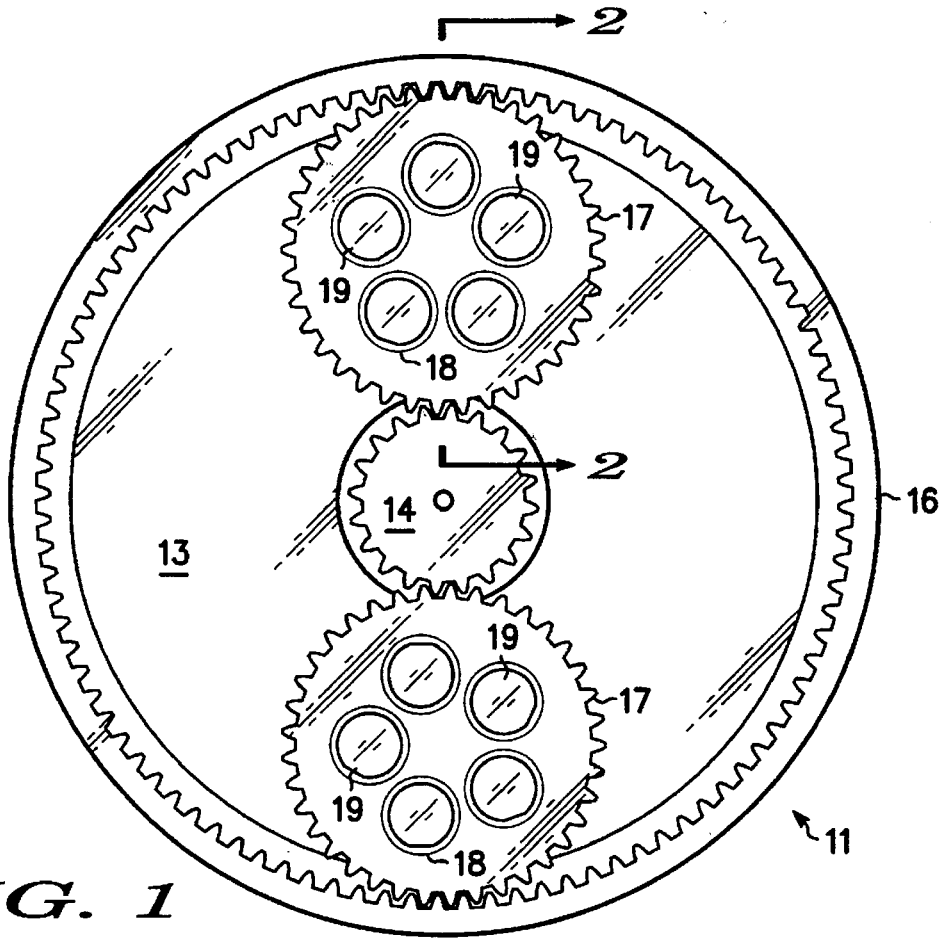
FIG. 1 illustrates a top view of a portion of a double sided polishing apparatus for use with the present invention.

With the semiconductor industry's push towards smaller geometry devices, some semiconductor chip manufacturers are requiring that starting substrates (i.e., substrates processed through polishing) exhibit a 100% yield to a less than 0.5 microns of SFPD using a back side reference. That is, a starting substrate must have 100% of measured sites with less than 0.5 microns in focal plane deviation. Future specifications are expected to require 100% yield to less than about 0.35 microns. Prior art substrate preparation techniques cannot meet these stringent requirements in a reproducible and cost effective manner.

Generally, the present invention provides an improved method whereby a double sided polisher apparatus is used to provide a semiconductor wafer that is very flat and that is polished on one side only. More particularly, a protective layer is formed on one major surface of the substrate to form a protected side and the substrate is then placed onto a double sided polisher. During the polishing process, material from the unprotected side is removed at a faster rate than material from the protected side. In a preferred embodiment, polishing pads having different surface tension characteristics are used to support process automation.

Methods are well known for producing semiconductor substrates and typically include the steps of single crystal semiconductor ingot growth, ingot shaping, flat formation, sawing, lapping, edge rounding, work damage/contamination removal, polishing, and final cleaning. During the polishing process, one side of an unpolished substrate typically is polished using chemical-mechanical techniques to produce a highly reflective, scratch free, and damage free surface.

Techniques are well known in the industry for producing substrates or wafers polished on one side only (i.e., single sided polishing). Manufacturers typically produce wafers polished on one side using equipment that polishes one side of a wafer, one wafer at a time. A wafer holder or chuck holds the wafer and presses it against a rotating polishing pad while polishing slurry is dripped onto the polishing pad to accomplish the polishing.

Typically, the polishing slurry is a colloidal suspension of fine silica ($SiO_2$) particles in an aqueous solution of sodium hydroxide. Under the heat generated by friction, the sodium hydroxide oxides the semiconductor material (e.g., silicon) with an $OH^-$ radical (the chemical step). The silica particles in the slurry then abrade the oxidized semiconductor material away (the mechanical step). Polishing rate and surface finish are a complex function of pressure, pad properties, rotation speed, and slurry composition.

Single sided polishing equipment has several disadvantages including a low throughput, with 10 wafers per hour being typical on single-wafer processing equipment. Additionally, single sided polishers typically do not provide wafers that exhibit the flatness characteristics required by IC manufacturers.

Double sided polishing equipment provides a much higher throughput (about 80 wafers per hour) than single sided polishing equipment and also produces wafers with superior flatness compared to wafers polished on single sided polishers. However, double sided polishing equipment is designed to concurrently polish both sides of a wafer. Herein lies one challenge, that is, to provide a method that incorporates double sided polishing equipment to achieve high throughput and superior wafer flatness while polishing only one side of a wafer. An additional challenge is to avoid impacting the intrinsic material characteristics of the wafers, which can lead to defects and impaired semiconductor device performance. A further challenge is do so without affecting the final wafer flatness. A still further challenge is do so in a cost effective manner.

FIG. 1 illustrates a top view of a portion of a typical double sided polisher apparatus for use with the present invention. Examples of double sided polishing equipment suitable for use with the present invention include equipment from P. R. Hoffman (e.g., the 4800 series), Peter Wolters (e.g., model no. AC1400), and Speedfam. Double sided polisher apparatus portion 11 includes a bottom plate 12 (shown in FIG. 2) with a lower polishing pad 13, inner or sun ring gear 14, outer ring gear 16, and wafer carriers 17. Wafer carriers 17 include holes or openings 18 for holding or retaining semiconductor substrates, substrates, or wafers 19. More or less wafer carriers may be used.

Each of wafers 19 includes a protective layer 21 (shown in FIG. 2) on a major surface or side 24 to form a protected surface. Protective layer 21 functions, among other things, to prevent major surface 24 from being polished during the polishing process. Major surface or side 26 of each of wafers 19 is left unprotected (i.e., major surface 26 is an unprotected major surface) so that major surface 26 is polished during the polishing process. Preferably, major surface 26 is adjacent lower polishing pad 13. Optionally, major surface 26, or the surface to be polished, is adjacent the upper polishing pad.

Preferably, protective layer 21 comprises a deposited protective layer such as a deposited dielectric layer (e.g., silicon oxide, silicon nitride, etc.). A deposited dielectric layer such as a deposited oxide is preferred because such films are formed at low temperatures (about 450° C. to about 650° C.), which helps reduce defect formation within wafers 19. Thermally grown films such as silicon dioxide tend to affect the intrinsic characteristics of wafers 19, which can impair semiconductor device performance and reliability.

Figure 2:
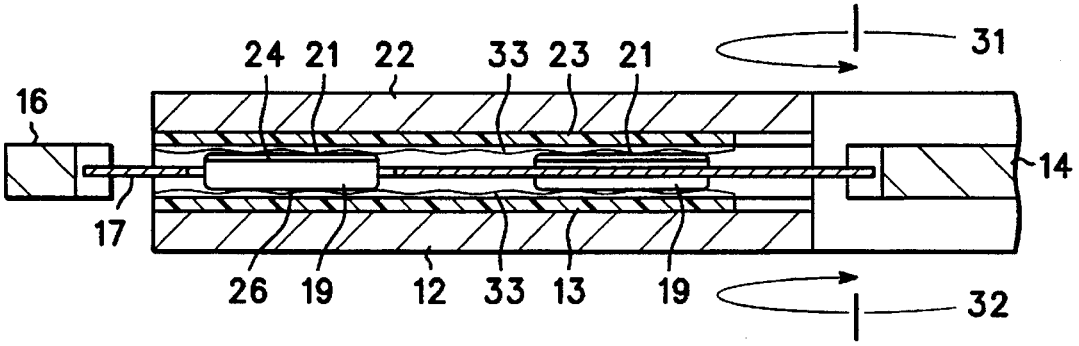
FIG. 2 illustrates a cross-sectional view of a portion of the apparatus of FIG. 1 taken along reference line 2—2.

FIG. 2 illustrates a cross-sectional view of apparatus 11 taken along reference line 2—2 in FIG. 1 with the addition of a top plate 22, an upper polishing pad 23 and slurry 33. During operation, slurry 33 is provided between upper polishing pad 23 and protective layer 21 and between lower polishing pad 13 and major surface 26 of each of wafers 19. Inner ring gear 14 and outer ring gear 16 drive wafer carriers 17 between upper polishing pad 23 and lower polishing pad 13 such that wafers 19 move in a serpentine pattern. The polishing pads retain and distribute slurry to provide a media for removing material from major surface 26 and from protective layer 21.

Typically, top plate 22 rotates in a first direction represented by arrow 31, bottom plate 12 is fixed or rotates in a direction represented by arrow 32, and inner ring gear 14 and outer ring gear 16 rotate in the same direction as top plate 22. In the prior art, the speeds with which top plate 22, inner ring gear 14, outer ring gear 16, and bottom plate 12 (when it is rotated) rotate are such that material is removed from both sides of the wafers as the same rate. This is because double sided polishing equipment typically is used to polish both sides of the wafers equally.

To provide a highly reflective, scratch free, and damage free surface, about 25 microns of material typically is removed from major surface 26 during a primary polishing process. To prevent major surface 24 from being polished, protective layer 21 must be greater than about 1.1 microns thick when protective layer 21 comprises a deposited dielectric such as a deposited silicon oxide. Protective layer 21 provides a reference plane for major surface 26 during polishing and therefore, its thickness must be substantially uniform across major surface 24 (e.g., less than about +/–2.5% of variation) to avoid impacting final wafer flatness. In order to achieve this uniformity, protective layer should be less than about 1.0 micron thick when protective layer 21 comprises a deposited oxide, with a thickness less than about 0.5 microns preferred. However, this preferred thickness range for protective layer 21 is not thick enough to avoid polishing major surface 24 when prior art double sided polishing methods are used.

According to the present invention, this problem is solved by removing material from protective layer 21 at a rate that is slower than the rate at which material is removed from major surface 26. In other words, removal selectivity is used during the polishing of major surface 26. For example, material from major surface 26 is removed at a rate that is in a range from about 10 to 40 times faster than the rate at which material is removed from protective layer 21. Preferably, material from major surface 26 is removed at rate that is in a range from about 18 to 20 times faster than the rate at which material is removed from protective layer 21. Using prior art techniques, material from major surface 26 is removed at a rate that is about 6 times faster than the rate at which material from protective layer 21 is removed.

This removal selectivity allows the thickness of protective layer 21 to remain below 1.0 micron to provide a uniformly thick protective layer, which in turn, provides a flat reference plane for major surface 26 during polishing. Additionally, protective layer 21 still prevents major surface 24 from being polished. With the selective removal, protective layer 21 preferably has a thickness of about 3,000 angstroms to about 5,000 angstroms when protective layer 21 comprises a deposited silicon oxide. When an epitaxial layer is to be subsequently grown on major surface 26, protective layer 21 preferably comprises a deposited silicon oxide having a thickness of about 8,000 angstroms Preferably, selective removal rates are achieved by adjusting the speeds with which top plate 22, inner ring gear 14, outer ring gear 16, and bottom plate 12 (when it is rotated) rotate. In the prior art, these speeds are selected so that during polishing, the frictional forces on major surface 26 equally oppose the frictional forces on major surface 24 so that no resultant stress is applied to wafers 19 and so that equal material removal rates are achieved.

Excessive stress applied to wafers 19 can cause both immediate and/or latent damage to them. In addition, excessive stress can cause wafers 19 to disengage from holes 18 in carriers 17 resulting in broken wafers and/or damaged carriers and pads. Accordingly, the speeds for top plate 22, inner ring gear 14, outer ring gear 16, and bottom plate 12 are selected to minimize any resultant stress on wafers 19 while achieving the differing removal rates.

Preferably, to minimize any resultant stress on wafers 19 and to provide the 18–20 to 1 removal selectivity, top plate 22 is rotated at a speed of about 11.0 rotations per minute (rpm), inner ring gear 14 is rotated at a speed of about 14.0 rpm, outer ring gear 16 is rotated at a speed of about 10.0 rpm, and bottom plate 12 is rotated at a speed of about 25.0 rpm (i.e., the top plate speed is about 45% of the bottom plate speed). These settings are suitable for double sided polishers with bottom plates that rotate (e.g., the Peter Wolters model no. AC1400). On equipment that does not have a rotating bottom plate, the above speeds are adjusted accordingly to provide the desired removal selectivity.

Preferably, a polishing slurry having a high removal rate (e.g., Nalco 2350, available from Rodel of Scottsdale, Ariz.) is used. Also, an applied pressure of about 1.0 pound per square inch of semiconductor material (e.g., silicon) is preferred (about 703 kilograms per square meter of semiconductor material). With the above conditions, material is removed from major surface 26 at rate of about 0.43 microns per minute. Typically, about 25 microns of material is removed from major surface 26 to provide a highly reflective, scratch free, and damage free surface. After a subsequent cleaning process, wafers 19 are ready for IC fabrication or are ready for epitaxial layer formation using well known techniques. Protective layer 21 is removed if no epitaxial layer is to be grown. Protective layer 21 is left in place for backseal purposes if an epitaxial layer is to be grown.

With the method according to the present invention, 100% of the wafers exhibited a 100% yield to the less than 0.5 micron SFPD requirement. As a comparison, 35% to 40% of wafers polished using conventional techniques exhibited a 100% yield to the less than 0.5 micron SFPD requirement. In addition, with the method according to the present invention, a significant number of wafers met the 100% yield to the less than 0.35 micron SFPD requirement while no wafers polished using convention techniques met this requirement. Thus, the process according to the present invention provides a wafer with superior flatness compared to prior art techniques. Also, the process according to the present invention is wafer diameter independent. Additionally, the method uses deposited protective layers, which do not affect the intrinsic material characteristics of the wafers.

When epitaxial layers are to be subsequently grown on major surface 26, protective layer 21 preferably has a final thickness of about 6,000 angstroms after major surface 26 is polished. This final thickness provides good backseal protection during epitaxial growth when protective layer 21 comprises a deposited oxide (e.g., deposited silicon oxide). To achieve this final thickness after polishing, protective layer 21 preferably has a starting thickness of about 8,000 angstroms when protective layer 21 comprises a deposited oxide. The removal selectively according to the present invention provides the desired protective layer 21 final thickness while at the same time avoiding an excessively thick protective layer to start with, thereby avoiding the non-uniformity/reference plane problems discussed above. Using prior art methods, protective layer 21 would require a starting thickness in excess of 1.2 microns. This starting thickness does not avoid the non-uniformity/reference plane problems discussed above.

Figure 3:
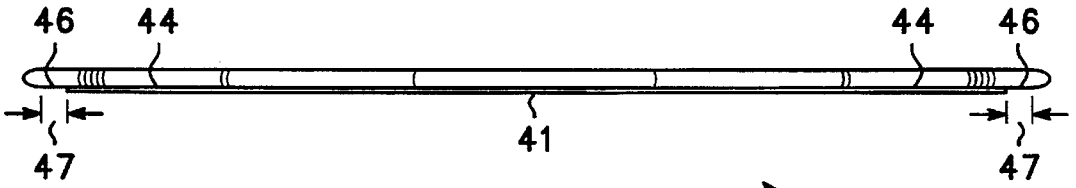
FIG. 3 illustrates a cross-sectional view of a preferred embodiment of a semiconductor substrate for use with the present invention.

FIG. 3 illustrates a side view of a wafer 39 having a protective layer 41 that does not extend entirely across major surface 44 leaving an unprotected ring or portion 46. In other words, wafer 39 has an edge excluded protective layer. Edge excluded protective layer 41 is preferred for wafers that will subsequently undergo an epitaxial growth process. Edge excluded protective layer 41 is preferred to avoid the formation of polycrystalline semiconductor material (e.g., polysilicon) around the peripheral edges of wafer 39 during the epitaxial layer growth process. Preferably, edge excluded protective layer 41 comprises a deposited oxide (e.g., deposited silicon oxide). Preferably, unprotected portion 46 has a width 47 less than about 5 millimeters. Techniques for forming edge excluded protective layer 41 are well known in the art and include mechanical removal techniques and photolithography/etch techniques.

An additional problem associated with using double sided polishers is that when top plate 22 is removed after polishing has finished, the wafers tend to adhere to upper polishing pad 23. When this happens, manufacturing personnel must manually remove the wafers from the upper polishing pad. This detrimentally impacts process automation, throughput, and quality. To support process automation, the wafers must remain on lower polishing pad 13 so that automatic wafer handling means can remove the wafers and place them, for example, into a wafer carrier.

According to the present invention, lower polishing pad 13 preferably comprises a material or design that creates a higher surface tension between major surface 26 and lower polishing pad 13 compared to the surface tension between protective layer 21 and upper polishing pad 23. For example, lower polishing pad 13 comprises a high surface area contact pad (e.g., a Rodel H2 or a SUBA 550 non-embossed polishing pad) and upper polishing pad 23 comprises a lower surface area contact pad (e.g., a Rodel H2E or a SUBA 550E embossed pad). With an embossed pad less surface contact area results from the grooves formed in the pad.

Thus, it should be appreciated that there has been provided a method for polishing one side of a semiconductor substrate using double sided polishing equipment, which is wafer diameter independent. By removing material from a protected surface at a slower rate than material from the an unprotected surface, wafers with superior flatness characteristics are achieved. These characteristic are reproducible and wafer diameter independent. Also, by using the differing removal rates, deposited protective films such as deposited oxides can be used thereby avoiding the formation of defects in the starting substrates. Additionally, by using polishing pads with differing surface contact characteristics, process automation is supported.

We claim:

1. A method for polishing a semiconductor substrate comprising the steps of:

providing a semiconductor substrate having a first major surface and a second major surface opposite the first major surface, the semiconductor substrate further having a deposited protective layer on the first major surface to form a protected surface;

placing the semiconductor substrate onto a double sided polisher having a first plate and a second plate; and concurrently polishing the protected surface at a first removal rate and the second major surface at a second removal rate, wherein one of the first and second plates is rotated at a slower speed thereby increasing the second removal rate, and wherein the deposited protective layer has a thickness that prevents the first major surface from being polished.

2. The method of claim 1 wherein the step of concurrently polishing includes concurrently polishing the protected surface at the first removal rate and the second removal rate, wherein the second removal rate is about 10 to about 40 times faster than the first removal rate.

3. The method of claim 2 wherein the step of concurrently polishing includes concurrently polishing the protected surface at the first removal rate and the second removal rate, wherein the second removal rate is about 18 to about 20 times faster than the first removal rate.

4. The method of claim 3 wherein the step of placing the semiconductor substrate onto the double sided polisher includes placing the semiconductor substrate onto the double sided polisher having an inner ring gear, an outer ring gear, a top plate with an upper polishing pad, and a bottom plate with a lower polishing pad, and wherein the step of concurrently polishing includes concurrently rotating the inner ring gear at about 14.0 rpm in a first direction, rotating the outer ring gear at about 10.0 rpm in the first direction, rotating the top plate at about 11.0 rpm in the first direction, and rotating the bottom plate at about 25.0 rpm in a second direction opposite the first direction, and wherein the protected surface is adjacent the upper polishing pad.

5. The method of claim 1 wherein the step of placing the semiconductor substrate onto the double sided polisher includes placing the semiconductor substrate onto the double sided polisher having an inner ring gear, an outer ring gear, the first plate with a first polishing pad, and the second plate with a second polishing pad, wherein the first polishing pad has less surface contact area than the second polishing pad.

6. The method of claim 5 wherein the step of placing the semiconductor substrate onto the double sided polisher includes placing the semiconductor substrate onto the double sided polisher having an embossed polishing pad on the first plate and a non-embossed polishing pad on the second plate.

7. The method of claim 1 wherein the step of providing the semiconductor substrate includes providing a semiconductor substrate having a deposited oxide on the first major surface.

8. The method of claim 7 wherein the step of providing the semiconductor substrate includes providing a semiconductor substrate having a deposited oxide on the first major surface, wherein the deposited oxide has a thickness in a range from about 3,000 angstroms to about 5,000 angstroms.

9. The method of claim 1 wherein the step of providing the semiconductor substrate includes providing a semiconductor substrate having an edge excluded protective layer on the first major surface.

10. The method of claim 9 wherein the step of providing the semiconductor substrate includes providing a semiconductor substrate having an edge excluded protective layer comprising a deposited oxide about 8,000 angstroms thick.

11. A process for polishing one side of a semiconductor wafer including the steps of:

placing a semiconductor wafer onto a double sided polisher, wherein the semiconductor wafer has a first surface, a second surface opposite the first surface, and a deposited dielectric layer formed on the first surface, and wherein the double sided polisher includes an upper polishing pad and a lower polishing pad; and simultaneously removing material from both the second surface and the deposited dielectric layer, wherein material from the second surface is removed at a first rate, and wherein material from the deposited dielectric layer is removed at a second rate, and wherein the first rate is about 10 to about 40 times faster than the second rate.

12. The process of claim 11 wherein the step of placing the semiconductor wafer onto the double sided polisher includes placing the semiconductor wafer onto a double sided polisher such that the deposited dielectric layer is adjacent the upper polishing pad, and wherein the upper polishing pad has less surface contact area than the lower polishing pad.

13. The process of claim 11 wherein the step of simultaneously removing material from both the second surface and the deposited dielectric layer includes simultaneously removing material from both the second surface and the deposited dielectric layer, wherein the first rate is about 18 to about 20 times faster than the second rate.

14. The process of claim 11 wherein the step of placing the semiconductor wafer includes placing a semiconductor wafer having a deposited oxide formed on the first surface, wherein the deposited oxide has a thickness in a range from about 3,000 angstroms to about 5,000 angstroms.

15. The process of claim 11 wherein the step of placing the semiconductor wafer includes placing a semiconductor wafer having an edge excluded protective layer formed on the first surface.

16. A polishing process comprising the steps of:

providing a substrate having a deposited protective film on one major surface to provide a protected major surface, the substrate further having an unprotected major surface opposite the protected major surface; and concurrently removing material from both the protected major surface and the unprotected major surface with a double sided polisher, wherein the double sided polisher includes a first plate with a first polishing pad, a second plate with a second polishing pad, and wherein the first plate and the second plate rotate, and wherein the unprotected major surface is adjacent the second polishing pad, and wherein the first plate moves at a slower speed than the second plate.

17. The process of claim 16 wherein the step of concurrently removing material includes concurrently removing material from both the protected major surface and the unprotected major surface, wherein the first plate moves at a first speed and the second plate moves at a second speed, wherein the first speed is about 45% slower than the second speed.

18. The process of claim 16 wherein the step of providing the substrate includes providing a substrate having a deposited oxide on the one major surface to provide the protected major surface.

19. The process of claim 16 wherein the step of concurrently removing material includes concurrently removing material with a first polishing pad that is embossed and a second polishing pad that is non-embossed.

* * * * *